US006056482A

United States Patent [19]

Calandra, Jr. et al.

[11] Patent Number: 6,056,482

[45] **Date of Patent: *May 2, 2000**

[54] CABLE BOLT HEAD

[75] Inventors: Frank Calandra, Jr.; Eugene H. Stewart, both of Pittsburgh; Stanley Ponce, Cresson; John G. Oldsen, Butler; John C. Stankus, Canonsburg, all of Pa.; Brian R. Castle, Rolla, Mo.

[73] Assignee: Jennmar Corporation, Pittsburgh, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/585,319

[22] Filed: Jan. 11, 1996

[51] Int. Cl.[7] ..... E21D 21/00

[52] U.S. Cl. ..... 405/302.2; 405/259.1

[58] Field of Search ..... 405/302.2, 259.1, 405/259.2, 259.3, 259.4, 259.5, 259.6

[56] References Cited

U.S. PATENT DOCUMENTS

| | | | |
|---|---|---|---|
| 3,077,809 | 2/1963 | Harding et al. | 85/2.4 |
| 3,226,934 | 1/1966 | Emery | 61/45 |
| 3,394,527 | 7/1968 | McLean | 52/741 |
| 3,507,121 | 4/1970 | Morfeldt | 61/39 |
| 3,971,177 | 7/1976 | Endo | 52/166 |
| 4,247,225 | 1/1981 | Chickini, Jr. et al. | 405/260 |
| 4,265,571 | 5/1981 | Scott | 405/259 |
| 4,378,180 | 3/1983 | Scott | 405/259 |
| 4,472,088 | 9/1984 | Martin | 405/259 |
| 4,531,861 | 7/1985 | Kash | 405/261 |
| 4,784,531 | 11/1988 | Calandra, Jr. | 405/261 |
| 4,798,501 | 1/1989 | Spies | 405/260 |
| 4,832,534 | 5/1989 | Duvieusart | 405/261 |
| 4,866,903 | 9/1989 | Ferstay | 52/677 |
| 4,896,416 | 1/1990 | Cranko et al. | 29/522.1 |
| 5,113,634 | 5/1992 | Lüthi | 52/741 |
| 5,230,589 | 7/1993 | Gillespie | 405/259.6 |
| 5,253,960 | 10/1993 | Scott | 405/302.2 |
| 5,259,703 | 11/1993 | Gillespie | 405/259.6 |
| 5,288,176 | 2/1994 | Huff et al. | 405/259.6 |
| 5,375,946 | 12/1994 | Locotos | 405/259.4 |
| 5,378,087 | 1/1995 | Locotos | 405/259.5 |
| 5,415,498 | 5/1995 | Seegmiller | 405/288 |
| 5,417,521 | 5/1995 | Scott | 405/259.6 |
| 5,462,391 | 10/1995 | Castle et al. | 405/302.2 |
| 5,466,095 | 11/1995 | Scott | 405/302.2 |
| 5,511,909 | 4/1996 | Calandra, Jr. et al. | 405/255.1 X |
| 5,570,976 | 11/1996 | Fuller et al. | 405/302.2 |
| 5,586,839 | 12/1996 | Gillespie | 405/302.2 X |

FOREIGN PATENT DOCUMENTS

| | | |
|---|---|---|
| 1059351 | 7/1979 | Canada . |
| 3435117 | 4/1985 | Germany . |
| WO93/03256 | 2/1993 | WIPO . |

OTHER PUBLICATIONS

Dywidag Systems International, USA, Inc; Dywidag Passive Cable Bolt publication: Feb. 1994; 1 sheet.

Stephen C. Tadolini and Jamie L. Gallagher; *Cable Bolts for Longwall Gate Entry Support;* pp. 77–89.

*Primary Examiner*—Tamara L. Graysay
*Assistant Examiner*—Frederick L. Lagman
*Attorney, Agent, or Firm*—Webb Ziesenheim Logsdon Orkin & Hanson, P.C.

[57] ABSTRACT

A plurality of designs for mine roof bolts is disclosed. Each mine roof bolt includes a flexible multi-strand cable having a first and second end with a drive head formed on the first end, the drive head having a plurality of driving faces on an exterior surface thereof. The drive head may be formed integrally with the multi-strand cable in one embodiment of the present invention. An alternative embodiment of the present invention forms a drive head as a separate member. With a separate drive head, a barrel and wedge assembly may be attached to the cable wherein the drive head is utilized substantially for rotating the cable.

5 Claims, 4 Drawing Sheets

CABLE BOLT HEAD

BACKGROUND OF THE INVENTION

1. Field of the Invention

The present invention relates to mine roof bolts. Specifically, the present invention relates to flexible mine roof bolts utilizing a multi-strand cable and which are adapted to be rotated in the bore hole by a drive head at a first end thereof.

2. Description of the Prior Art

Flexible cable bolts and cable systems have been utilized in the construction and mining industries since about 1970. More recently, cable mine roof bolts have been utilized as a roof control in the mining industry with both resin grouting and more conventional cement grouting techniques. Examples of cable mine roof bolts utilized in resin grouting applications can be found in U.S. Pat. Nos. 5,230,589 to Gillespie; 5,259,703 to Gillespie; 5,375,946 to Locotos; and WIPO Publication No. WO 93/03256 to Fuller et al. All of these mine roof bolt designs incorporate some type of drive head assembly for rotating the cable bolt. All of these prior art systems suffer from various drawbacks.

The mine roof bolt disclosed in the Gillespie patents replaces a tubular barrel of a conventional barrel and wedge assembly with a specially machined hexagonal head collar. The hexagonal head collar must necessarily be large enough to receive the internal wedges therein which make the head collar too large to be driven with conventional bolting equipment. consequently, in addition to the special machining of the hexagonal drive head, the Gillespie patents require the use of specialized adapters by the bolting equipment to accommodate the enlarged hexagonal head.

WIPO Publication No. WO 93/03256 and the Locotos patent disclose cable mine roof bolts which utilize a hex nut attached to the end thereof to both rotate the cable bolt and support the bearing plate. The WIPO publication discloses inclusions of threads on at least one of the strands of the cable so that the hex nut can be threaded directly onto the cable. The Locotos patent utilizes a collar having a threaded end which is attached to the cable with the hex head threaded onto the collar. These designs require the attachment of the hex nut to the cable to meet the loading capacity of the cable bolt since the drive heads also serve to support the bearing plate.

It is the object of the present invention to provide a mine roof bolt design which overcomes the disadvantages of the above-described prior art. It is a further object of the present invention to provide a mine roof bolt design which can be utilized with conventional roof bolting equipment. A further object of the present invention is to provide a mine roof bolt which is easy and economical to manufacture.

SUMMARY OF THE INVENTION

A first embodiment of the present invention achieves the above-described objects by providing a mine roof bolt which includes a flexible multi-strand cable having a first end and a second end with a drive head integrally formed on the first end. The drive head has a plurality of driving faces on an exterior surface thereof. The integrally formed drive head may be cast onto a splayed first end of the cable or, alternatively, may be forged on the first end being formed, in part, by a multi-strand cable at the first end. A sleeve may be provided surrounding the first end of the cable to assist in forming the drive head during the foregoing operation such that part of the sleeve and part of the first end of the cable combine to form all of the forged drive head.

The flexible mine roof bolt which includes the forged drive head, according to the first embodiment of the present invention, may be formed as follows. At least a first end of a flexible multi-strand cable is heated to the appropriate forging temperature and the drive head is forged on the heated first end by an appropriate shaped die in a forging machine wherein the multi-strand cable at the heated first end forms at least part of the forged drive head. The method of the present invention may additionally include the step of attaching a sleeve to the first end of the cable prior to heating. With an attached sleeve, both the first end of the cable and the sleeve are heated and subsequently forged wherein the drive head is formed by material from the sleeve and from the multi-strand cable. The sleeve may be attached by swaging, use of an adhesive, welding, or combinations thereof. Additionally, metal filings may be incorporated within the adhesive to provide a more secure bond of the sleeve to the multi-strand cable.

The objects of the present invention are achieved by a second embodiment of the present invention by providing a mine roof bolt which includes a flexible multi-strand cable, a barrel and wedge assembly attached to the cable between first and second ends thereof and a drive head attached to the multi-strand cable at a position spaced along the cable from the barrel and wedge assembly with the drive head having a plurality of driving faces on an exterior surface thereof.

In the second embodiment, the drive head may be positioned adjacent the barrel and wedge assembly wherein the drive head extends less than one inch beyond the barrel and wedge assembly. Alternatively, the mine roof bolt of the second embodiment may further include a sleeve member surrounding the cable which is formed integrally with the drive head. The sleeve member may be positioned to extend partially into the barrel of the barrel and wedge assembly. The sleeve member may be attached to the cable by swaging, adhesives, welding, or combinations thereof. Additionally, the drive head may include a central bore therethrough for receiving the cable. The drive head may be secured to the cable by use of adhesives or a cable spreading wedge or a combination thereof. A cable spreading wedge may be inserted into a first end of the cable which is received within the bore of the drive head. The cable spreading wedge will bias the outer strands of the cable against the drive head to secure the cable to the drive head.

These and other advantages of the present invention will be clarified in the brief description of the preferred embodiments wherein like reference numerals represent like elements throughout.

BRIEF DESCRIPTION OF THE PREFERRED EMBODIMENTS

Figure 1:
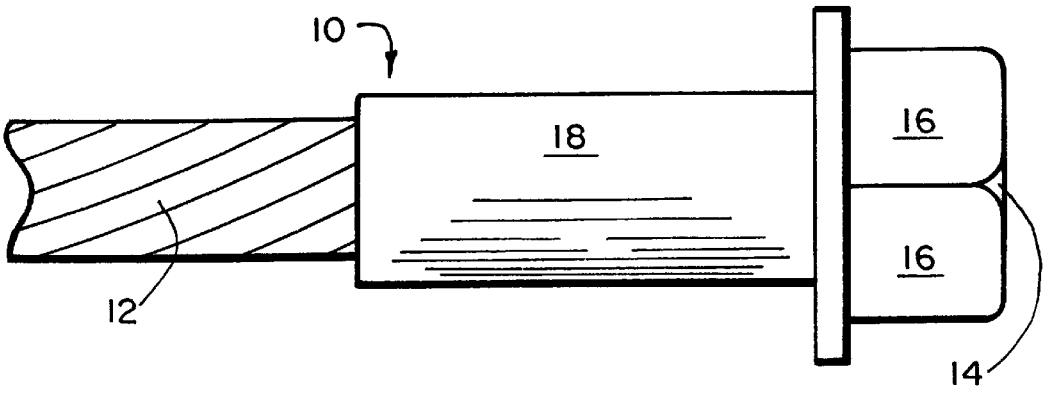
FIG. 1 is a side view of a cable mine roof bolt according to the first embodiment of the present invention.
Figure 2:
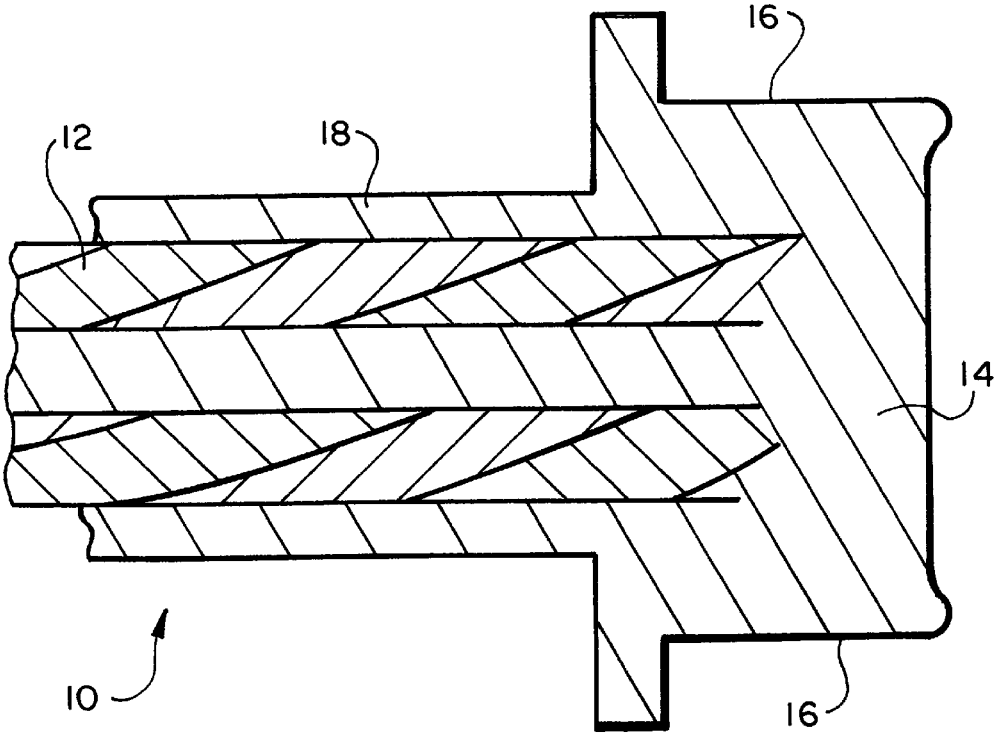
FIG. 2 is a enlarged sectional view of the cable mine roof bolt illustrated in FIG. 1.

FIGS. 1 and 2 illustrate a cable mine roof bolt 10 according to the present invention. The mine roof bolt 10 includes a central cable 12 which is adapted to be received into a bore hole. The cable 12 is preferably standard seven-wire cable which is described in ASTM designation A 416 entitled "Standard Specification for Steel Strand, Uncoated Seven-Wire for Prestressed Concrete". The cable 12 is preferably of a seven-strand type which has a center strand enclosed tightly by six helically wound outer strands with a uniform pitch of between twelve and sixteen times the nominal diameter of the cable. The cable 12 generally comes in grades determined by the minimum ultimate strength of the cable. For example, Grade 250 has a minimum ultimate strength of 250,000 psi and Grade 270 has a minimum ultimate strength of 270,000 psi. Additionally, bird cages may be incorporated into the length of the cable 12 at selected positions thereon. Similarly, buttons can be swaged onto the cable 12 at spaced positions thereon. The bird cages and buttons help improve the mixing of the resin as well as increase the bond strength of the attachment as is known in the art.

At a first end of the cable 12 is an integral drive head 14. The drive head 14 includes four planar driving faces 16 formed on an exterior surface thereof. The four driving faces 16 form a substantially one inch square drive head on the drive head 14. A sleeve 18 surrounds the cable 12 at the first end thereof. The sleeve 18 is adjacent to and integral with the drive head 14.

Figure 3:
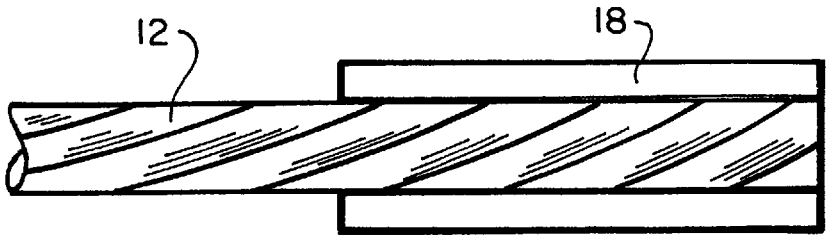
FIG. 3 illustrates the first step in manufacturing the cable mine roof bolt illustrated in FIGS. 1 and 2 according to the method of the present invention.

The mine roof bolt 10 can be formed according to the following method. The cable 12 is cut slightly larger than the ultimately desired length. A sleeve 18 is attached to the cable 12 at the first end thereof with the sleeve 18 flush with the first end of the cable 12 as shown in FIG. 3 and Step 20 in FIG. 4. The sleeve 18 can be attached to the cable 12 by swaging, adhesives, welding, or combinations thereof. Additionally, if adhesives are utilized to attach the sleeve 18 to the cable 12, metal filings or metal powder may be incorporated to the adhesives to increase the bond strength. The interior of the sleeve 18 may also be roughened to increase bond strength. The attachment of the sleeve 18 to the cable 12 is not believed to be critical since this particular attachment will not be required to withstand the loading strength of the mine roof bolt 10.

Figure 4:
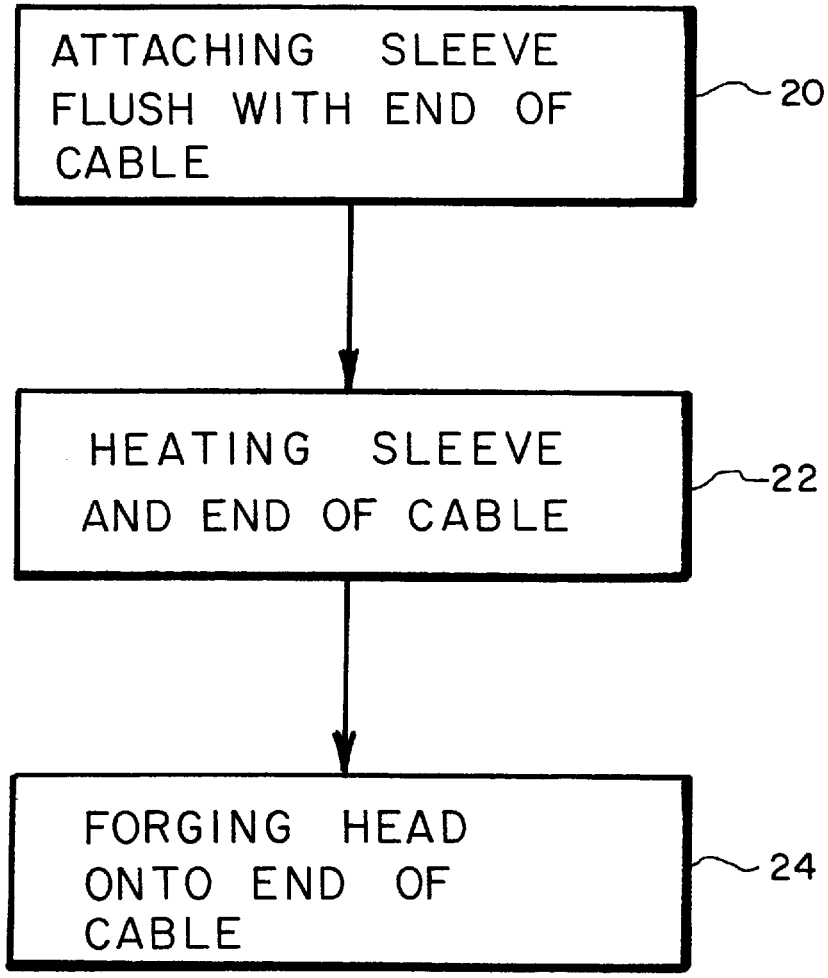
FIG. 4 is a flow chart illustrating the method of the present invention of manufacturing the cable mine roof bolt illustrated in FIGS. 1 and 2.

The sleeve 18 and the first end of the cable 12 are then heated to an appropriate forging temperature as noted in Step 22 in FIG. 4. The sleeve 18 and the first end of the cable 12 are then inserted into a forging machine where appropriate shaped dies will be utilized to form the drive head 14 with appropriately shaped driving faces 16 as noted in Step 24 of FIG. 4. In this manner, the drive head 14 is forged onto the first end of the cable 12 such that the first end of the cable 12 and the sleeve 18 combine to form the drive head 14.

By forming the drive head 14 integral with the cable 12 by forging, the drive head 14 meets the loading requirements of the mine roof bolt 10. The drive head 14 will be utilized to support a bearing plate assembly in a conventional manner. Additionally, the drive head 14 will be utilized for rotating the mine roof bolt 10 in the resin grouted installations in a conventional manner as known in the art.

The drive head 14 may be forged directly on the first end of the cable 12 without the use of the sleeve 18. However, without the sleeve 18, a longer portion of the first end of the cable 12 will be required to form the drive head 14 which increases the difficulty in the forging operation. The sleeve 18 assists in the forging operation and provides a stiffener for the first end of the cable. Furthermore, if desired, the mine roof bolt 10 of the present invention may further include a conventional barrel and wedge assembly (not shown) to support the bearing plate. Barrel and wedge assemblies are well-known and are well-accepted mechanisms for retaining tensioned cable systems in place such as retaining a bearing plate against a roof. If a barrel and wedge assembly is utilized with the mine roof bolt 10, the forged drive head 14 will only need to have strength requirements for rotating the mine roof bolt 10 during installation.

Figure 5:
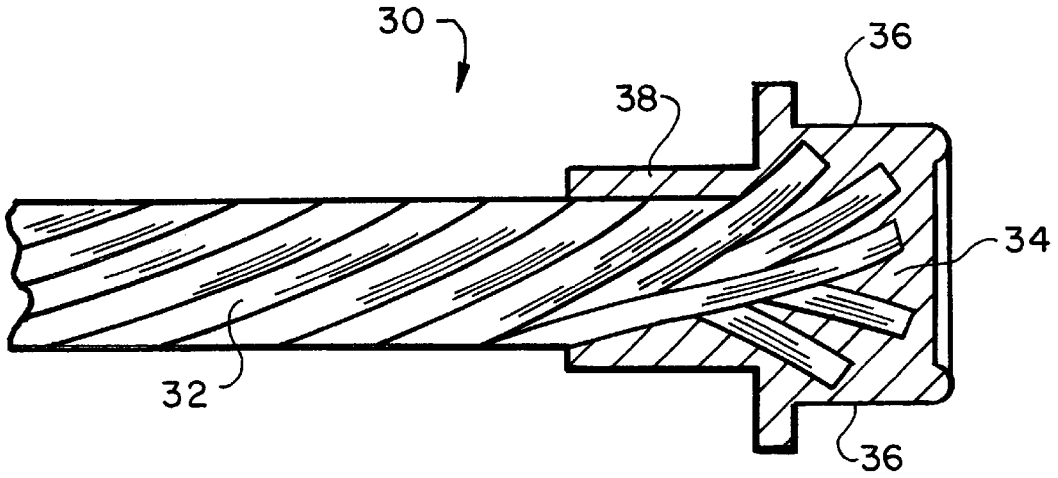
FIG. 5 is a side view of a cable mine roof bolt according to a second embodiment of the present invention.

FIG. 5 illustrates a cable mine roof bolt 30 according to a second embodiment of the present invention. The mine roof bolt 30 includes a multi-strand cable 32 which is substantially identical to the cable 12 described above. A first end of the cable 32 is splayed. A drive head 34 is cast directly onto the splayed first end of the cable 32. The drive head 34 includes four planar driving faces 36 forming a substantially one inch square drive head substantially the same as the driving faces 16 and drive head 14 described above. The splaying of the first end of the cable 32 assures a secure attachment of the integral, cast drive head 34. A stiffener sleeve 38 may be utilized adjacent the drive head 34 and may be formed integrally with the drive head 34 during the casting operation. The mine roof bolt 30 is used in a conventional fashion as described above in connection with mine roof bolt 10. Mine roof bolt 30 may also be utilized with the conventional barrel and wedge assembly (not shown) wherein the drive head 34 would be required only for rotating the mine roof bolt 30.

Figure 6:
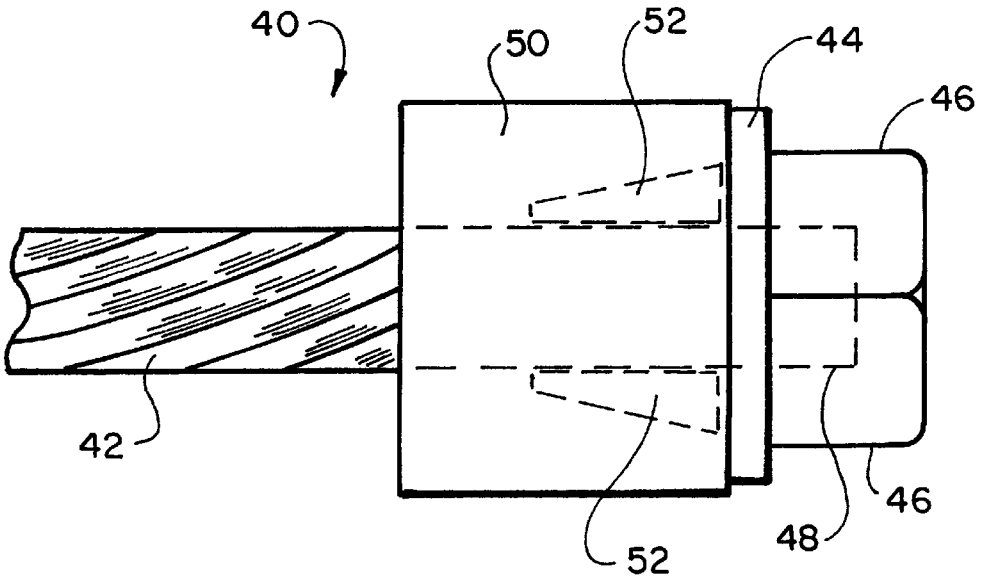
FIG. 6 is a side view of a cable mine roof bolt according to a third embodiment of the present invention.

FIG. 6 illustrates a cable mine roof bolt 40 according a third embodiment of the present invention. The mine roof bolt 40 includes a cable 42 substantially the same as cables 32 and 12 described above. The mine roof bolt 40 includes a drive head 44 attached to a first end of the cable 42. The drive head 44 includes four substantially planar driving faces 46 to form a substantially one inch square drive head substantially the same as described above in mine roof bolts 30 and 10. The drive head 44 includes a central bore 48 therein for receiving the first end of the cable 42. The central bore 48 may extend partially through the drive head 44, as shown, or entirely therethrough. Additionally, the central bore 48 may be tapered to more securely hold the cable. The drive head 44 can be attached to the cable by use of resin adhesives or the like. The adhesives may include metal filings or metal powder mixed therein to increase the bonding strength thereof. Additionally, the central bore 48 of the drive head 44 may be roughened to increase bond strength. Pilot holes (not shown) may extend into the central bore 48 transversely thereto. Transverse pilot holes may be used to supply additional adhesives into the central bore 48 after the cable is positioned therein. The mine roof bolt 40 additionally includes a barrel and wedge assembly adjacent the drive head 44. The barrel and wedge assembly includes a substantially tubular barrel 50 and internal locking wedges 52 which surround and securely grip onto the cable 42. The barrel and wedge assembly is a conventional, well-known and accepted mechanism for receiving the loading requirements of a mine roof bolt. In operation, the barrel 50 will be adjacent and will support a bearing plate. In this embodiment, the drive head 44 is only utilized for rotating the mine roof bolt 40 during resin grouting installation. Consequently, the attachment of the drive head 44 to the cable 42 needs only be sufficiently strong to receive the torque in turning of the mine roof bolt 40. The mine roof bolt 40 is specifically designed to have a minimal profile of less than about one inch beyond the barrel and wedge assembly. Consequently, the drive head 44 preferably abuts the barrel 50 to minimize this profile. The minimum profile of the mine roof bolt 40 is an important requirement in the confined spaces of a mining environment.

Figure 7:
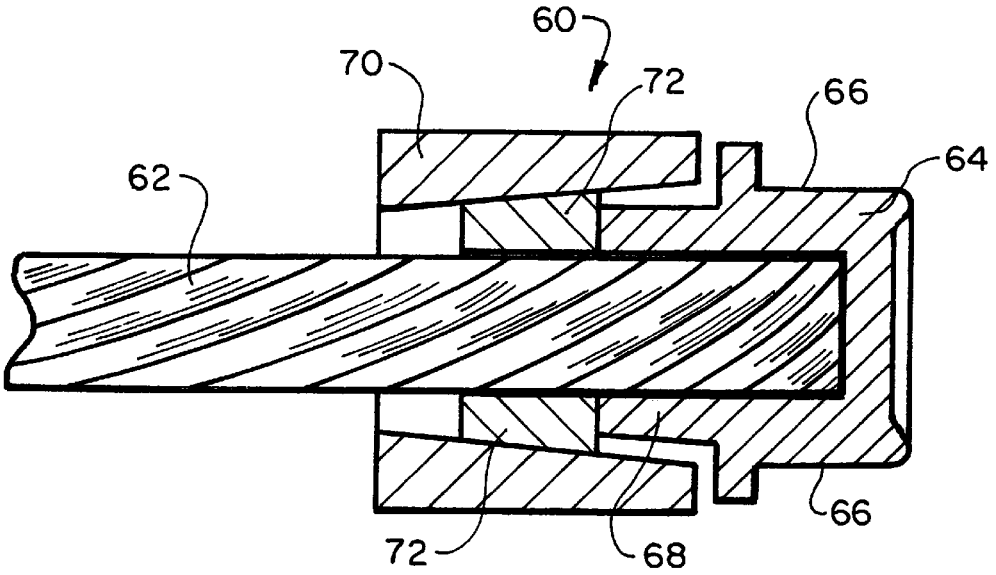
FIG. 7 is a side view, partially in section, of a fourth embodiment of the present invention.

FIG. 7 illustrates a mine roof bolt 60 according to a fourth embodiment of the present invention. The mine roof bolt 60 is substantially similar to the mine roof bolt 40 and includes a cable 62, drive head 64 with driving faces 66 and central bore 68. A barrel and wedge assembly is provided with barrel 70 and locking wedges 72 surrounding the cable 62. The mine roof bolt 60 differs from mine roof bolt 40 in two respects. First, the drive head 64 includes an integral sleeve member 74 which surrounds the cable 62. The sleeve member 74 allows the drive head 64 to be attached to the first end of the cable 62 by swaging, adhesives, or combinations thereof. As described above, metal powder or filings may be incorporated into the adhesives increasing the bonding strength thereof as well as roughing of the interior of the sleeve member 74. The addition of the sleeve member 74 allows for swaging the sleeve member 74 and associated, integral drive head 64 to the cable 62. Additionally, the length of the sleeve member 74 can be selected to achieve the appropriate bonding needed between the drive head 64 and the cable 62 by adhesives and/or swaging. An increase in the length of the sleeve member 74 will correspond to an increase in the bonding strength therebetween. An additional distinction between the mine roof bolt 60 and the mine roof bolt 40 is that the locking wedges 72 have been decreased in length so that the sleeve member 74 can be received, in part, within the barrel 70. This construction minimizes the overall profile of the mine roof bolt 60 below the barrel and wedge assembly.

Figure 8:
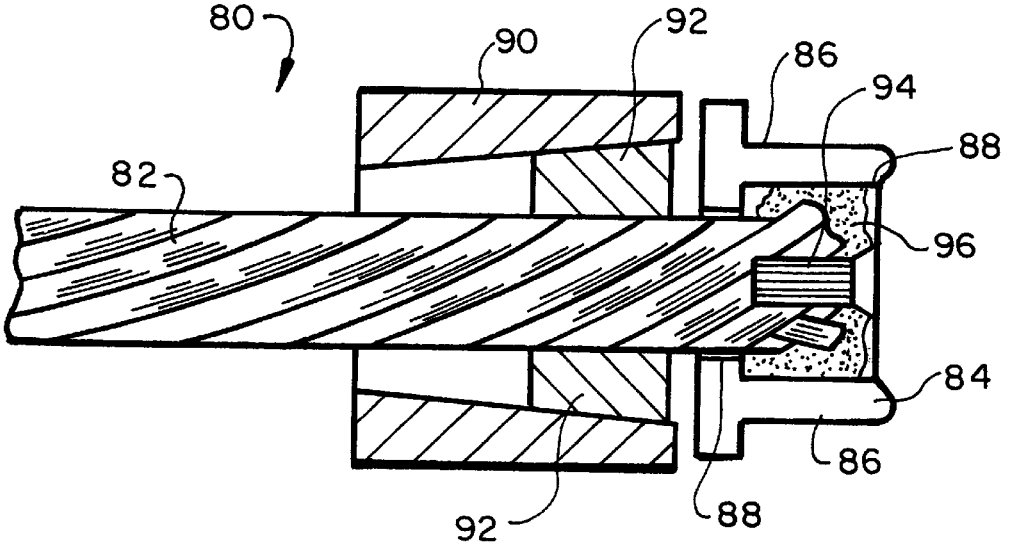
FIG. 8 is a side view, partially in section, of a fifth embodiment of a cable mine roof bolt according to the present invention.

FIG. 8 illustrates a mine roof bolt 80 according to a fifth embodiment of the present invention. The mine roof bolt 80 is substantially similar to mine roof bolts 40 and 60 described above and includes a cable 82, drive head 84 with driving faces 86 and central bore 88 and a barrel and wedge assembly comprised of barrel 90 and locking wedges 92. The mine roof bolt 80 differs from mine roof bolt 40 shown above in that the central bore 88 extends through the drive head 84. Additionally, a cable spreading wedge 94 is driven into the first end of the cable 82 to bias the outer peripheral strands of the cable 82 against the drive head 84 to secure the drive head 84 to the cable 82. Additionally, molten metal 96 is poured onto the outer end of the central bore 88 to further secure the cable 82 to the drive head 84. The cable spreading wedge 94 and metal 96 may be used in conjunction with adhesives on the internal portions of the bore 88 as described above in connection with mine roof bolt 40. Additionally, the outer end of the central bore 88 may be stepped or even flared out to provide for a more secure attachment of the drive head 84. The advantage of the mine roof bolt 80, similar to the mine roof bolts 60 and 40 described above, is that the connection of the drive head 84 to the cable 82 needs only be sufficiently strong to receive the rotational forces imposed during turning. The loading requirements will be achieved by the conventional barrel and wedge assembly.

In all of the embodiments described above, the drive heads fit conventional bolting equipment without requiring additional adapters. Additionally, the drive heads are easily incorporated onto the mine roof bolt.

It will be apparent to those of ordinary skill in the art that various changes and modifications may be made to the present invention without departing from the spirit and scope thereof. Consequently, the scope of the present invention is intended to be defined by the attached claims.

What is claimed is:

1. A mine roof bolt comprising:

a flexible multi-strand cable having a first end and a second end; and a drive head integrally formed on said first end, said drive head having a plurality of driving faces on said exterior surface thereof, wherein material of said multi-strand cable at said first end forms at least a portion of said integral drive head.

2. The mine roof bolt of claim 1 wherein said drive head is forged on said first end, and wherein said multi-strand cable at said first end forms at least part of said drive head.

3. The mine roof bolt as claimed in claim 1 further comprising a sleeve surrounding said cable and positioned adjacent said drive head, wherein said drive head is formed integrally with said sleeve.

4. The mine roof bolt of claim 3 wherein part of said sleeve and part of said multi-strand cable at said first end form all of said forged drive head.

5. A mine roof bolt comprising:

a flexible multi-strand cable having a first end and a second end, wherein said first end of said multi-strand cable is splayed such that individual cables are separated and spaced from each other at said first end; and a drive head formed on said first end of said multi-strand cable, said drive head having a plurality of driving faces on an exterior surface thereof, wherein said drive head is cast directly onto said splayed first end whereby material forming said drive head is positioned between said strands of said multi-strand cable at said first end.

* * * * *